United States Patent [19]

George

[11] 4,382,043

[45] May 3, 1983

[54] AUTOMATIC CHOKE

[75] Inventor: Hiddle Walstra; Gerrit J. Beunk; Peter G. vanRiet Paap, all of Almelo, Netherlands

[73] Assignee: Texas Instruments Incorporated, Dallas, Tex.

[21] Appl. No.: 81,756

[22] Filed: Oct. 4, 1979

[30] Foreign Application Priority Data

Oct. 4, 1978 [NL] Netherlands ..... 7810020

[51] Int. Cl.[3] ..... F02M 1/12

[52] U.S. Cl. ..... 261/39 E

[58] Field of Search ..... 261/39 E

[56] References Cited

U.S. PATENT DOCUMENTS

| | | | |
|---|---|---|---|
| 1,953,785 | 4/1934 | Sullivan | 55/507 |
| 3,972,311 | 8/1976 | DePetris | 261/39 E |
| 4,058,097 | 11/1977 | Silverstein et al. | 261/39 E |
| 4,131,657 | 12/1978 | Ball, Jr. et al. | 261/39 E |
| 4,152,377 | 5/1979 | Takata | 261/39 B |
| 4,237,077 | 12/1980 | Berg | 261/39 E |

FOREIGN PATENT DOCUMENTS

| | | | |
|---|---|---|---|
| 52-74724 | 6/1977 | Japan | 261/39 E |

*Primary Examiner*—Tim R. Miles

*Attorney, Agent, or Firm*—James P. McAndrews; John A. Haug; Melvin Sharp

[57] ABSTRACT

The present invention relates to an automatic electrical choke, disposed inside the intake system of a gasoline engine, consisting of a bimetallic helical spring the movable end of which has an eyelet for operating the choke valve, while its second end is fastened on a fixed fastening element which is mounted inside a case, which fastening element has a ground connection and is connected electrically and thermally conducting with at least one electrical heating element with positive temperature coefficient, which is electrically connected to a current source.

6 Claims, 5 Drawing Figures

AUTOMATIC CHOKE

Such chokes are generally known.

An automatic choke regulates, among other things, the fuel-air mixture of the motor from the starting until the time at which the motor is at the correct operating temperature. This regulation is required since in this phase condensation of gasoline occurs between the carburetor and the combustion chamber. A valve connected with the automatic choke provides an enriched gasoline-air mixture in the said phase.

It is necessary for an efficient combustion that the choke valve opens according to a given characteristic (rotation/time).

All known automatic electrical chokes have the drawback that the cooling time of the spring, after switching off the motor, is not in agreement with the cooling time of the motor. The helical spring cools down much faster with the result that the choke valve closes while the motor is still warm. With a new starting of the motor the combustion chamber will now get a too rich fuel-air mixture, which causes an incomplete combustion (poor starting and contamination of the exhaust gases).

To improve the cooling characteristics, the known chokes require additional elements, viz. a water connection on the housing whereby the cooling water of the motor is conveyed via a conducting system to the automatic choke, the heat content and the thermosiphon effect of the water leading to a longer cooling period, or a thermostat which, after stopping the motor, keeps connected one or more heating elements until such time that the temperature of the motor drops below a given value.

It is obvious from the above that with the known automatic electrical chokes it is not possible to obtain an optimal angular displacement of the bimetallic helical spring, i.e. an optimal setting of the choke valve. The choke valve must always be able to be set in such a way that there be always available the right air-fuel mixture ratio in the motor and that there be achieved a complete combustion of the mixture. At the same time, a maximal saving in fuel will then be achieved.

The present invention has as its object to remedy the aforementioned drawbacks and create such an optimal setting of the choke valve, and is thus characterized in that the fastening element consists of a solid metallic disk one side of which is provided with a stump on which the said end of the helical spring is fastened, the end of the stump facing away from the disk containing a screening plate.

Both as regards effect and assembly, the present invention provides considerable improvement over the existing automatic electrical chokes.

A not perfect aligning of the windings of the helical spring, i.e. lying in one plane, has no longer an effect on the speed of rotation of the helical spring. Through an improvement of efficiency, a faster rotation time is made possible (a double heat transfer through radiation and convection to the helical spring). Cooling of the helical spring on account of air steams during driving is considerably reduced, while the total angular displacement during stabilizing of the heat equilibrium is greater which leads to a longer turn back time that is more in agreement with the cooling down time of the motor.

In addition, the insulated mass to be heated is increased and so placed insulated that the cooling down time is in agreement with that of the motor. Furthermore, the manner of mounting of the screening plate by means of a rotating folder on the stump is such that the helical spring is enclosed and the whole is stable to substantial vibrations. By mounting the stump on the metallic disk, on the side on which the heating elements are placed, it becomes possible to bring the position of the eyelet of the spring in a fixed relationship to the accomodating cavity for the setting of the metallic disk so that after placing in the housing of plastic a fixed relationship to a marking groove provided in the outer wall of the housing is obtained. As a result, a separate calibration and marking on the housing in respect of the eyelet is dispensed with and the position of a plug connection of the automatic choke is fixed, thus providing more spacious placing possibilities.

The invention will now be more fully explained on hand of the drawings, wherein

Figure 1:
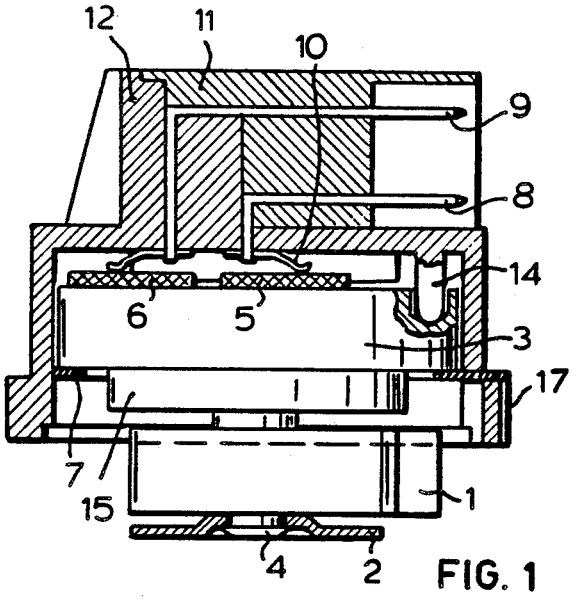
FIG. 1 shows a longitudinal section of an automatic choke according to the invention.
Figure 2:
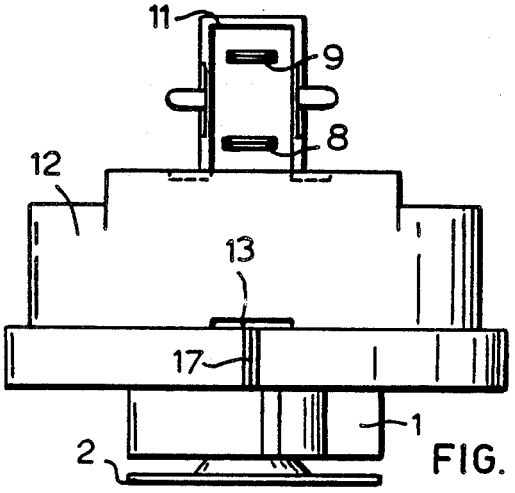
FIG. 2 shows an end view of the choke according to the invention.

The choke according to the present invention consists of a solid metallic disk 3 with a shoulder 15 one side of which is provided with a stump 4 fastened thereon upon which the end of a bimetallic helical spring 1 is accomodated in a groove of the stump, which stump has a screening plate 2 on the side facing away from the disk. The disk is fastenable in a housing 12 by means of eccentrically mounted centering and fixing studs 14 which are provided on the inside of the housing and inserted in cavities in the disk. The cavities (usually three) are placed eccentrically in the disk and the studs 14 inserted therein serve simultaneously as spacing means between the disk and the inner wall of the housing, so that cooling via the inside of the housing 12 is prevented. The disk with its shoulder and stump has a large mass and, therefore, a large heat capacity, which substantially contributes to the desired optimal setting of the choke valve. Due to the fact that in the present choke the helical spring is enclosed on both sides and carried between the shoulder and the screening plate, and in spite of the fact that the windings of the helical spring never come to lie perfectly in one plane by reason of its large-scale production, a uniform transfer of heat through convection and radiation will take place between the shoulder and screening plate and the helical spring, which likewise contributes to an optimal setting of the choke valve and a homogeneous heat distribution in the various parts of the choke.

The screening plate 2 serves simultaneously as protection of the helical spring against the cooling effect of the ventilation air.

Figure 3:
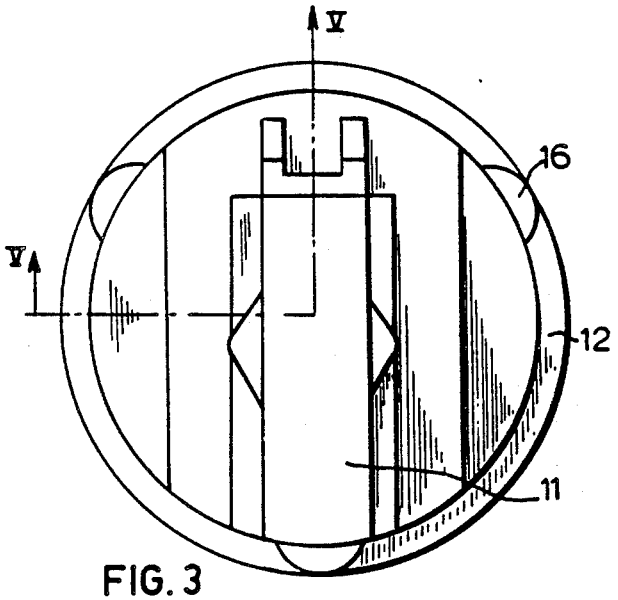
FIG. 3 shows a top view of the choke according to the invention.
Figure 4:
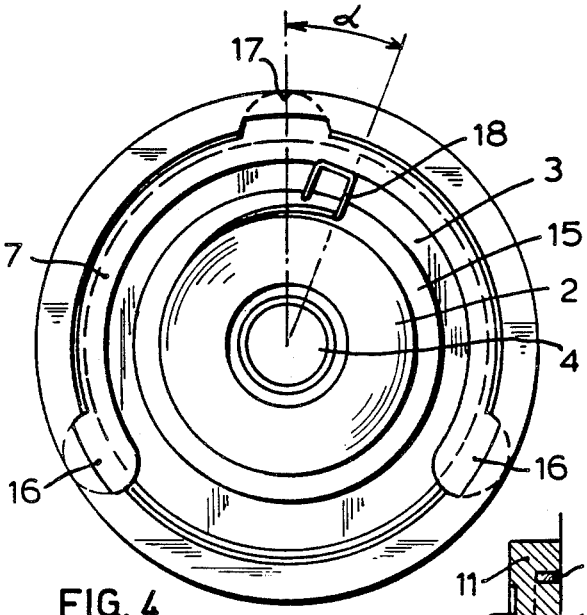
FIG. 4 shows a bottom view of the choke according to the invention.
Figure 5:
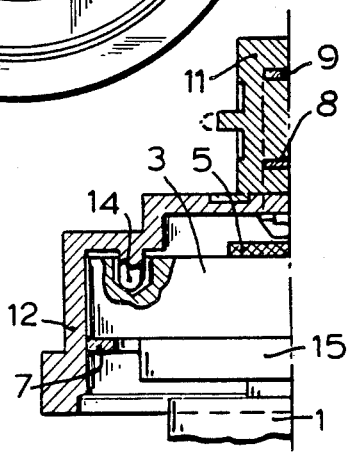
FIG. 5 shows a partial cross sectional view of the choke along arrows V—V of FIG. 3.

The disk is held in the housing by means of an elastic ring 7 which is provided with lips 16 (FIG. 3) that are insertible in corresponding openings 13 in the wall of housing 12. In this particular embodiment of the invention, two heating elements 6,5 are fastened on the disk. Preferably, one heating element 5 is mounted at the center of the disk and the second heating element 6 at a distance apart from the first element. The heating elements are made from an electrical resistance material with positive temperature coefficient and are connected electrically conductive with a current source of the motor. It is also possible to use a single electrical heating element with two contact surfaces, the said contact surfaces having the same effect as the aforementioned two heating elements.

On the housing, a connection box 11 is fastened. The box has two rod-shaped electrical conductors 8, 9, one conductor being connected via a thermostat to a current source of the motor. This thermostat is operated by rising or falling motor temperatures. The second conductor is connected electrically conducting directly with the aforementioned current source. The electrical connection of the conductors with the heating elements takes place by means of elastic contacts 10. The disk with its shoulder and stump with covering plate are made from an electrically and thermally conductive material, aluminum for example. The thickness of the disk with shoulder is a function of the heat capacity required for a sure cooling off time (determined by the type of motor) and is approximately 12 mm in the present embodiment of the invention.

The mounting of the semiproduct or subassembly consisting of heating elements, disk, stump, helical spring and screening plate in a housing of plastic is effected by means of an elastic ring in such a way that the semiproduct can be mounted only in one manner with the aid of studs disposed eccentrically inside the housing and therewith cooperating cavities in the disk. The semiproduct is thereat centered in such a way that the housing is contacted solely on these studs, which assures an improved insulation. By means of the elastic ring, the semiproduct is pressed onto the studs. The ring further provides for an anchoring of the semiproduct inside the housing with the aid of the said three lips which click in the three cavities in the housing, and for an electrical connection to the ground.

The outer wall of housing 12 has a marking groove 17 which serves as reference point for the position of eyelet 18 of the helical spring when not under tension, when the disk is placed insice the housing into its position determined by studs 14. The stump with helical spring and covering plate are inserted in an axial cavity of the disk and turned until the eyelet hits a stop (not shown), the stump is then in this position fixed on the disk by means of folders. With this, the angle $\alpha$ is fixed and therewith a fixed position of the eyelet in respect of studs 14, the groove and plug connection. The size of angle $\alpha$ is determined by the type of carburetor for which the choke is to be used.

All the aforementioned improvements are not limited to the embodiments described above, said improvements being also present in automatic electrical chokes with one heating element, e.g. an incandescent spiral.

We claim:

1. A control for a choke valve in a gasoline engine comprising a subassembly having a disc, a stump fastened to the disc, a bimetallic helical spring which has a fixed end fastened to the stump and a movable end for operating the choke valve, and at least one electrical heating element, and a housing having a cavity with a side wall accommodating the disc, characterized in that the disc has plural cavities therein, the housing has studs inside the housing cavity inserted into the disc cavities locating the disc in the housing cavity spaced from the side wall of the housing cavity, and an elastic ring is fitted into the housing cavity side wall holding the disc in the housing cavity.

2. A control for a choke valve in a gasoline engine comprising a subassembly having a disc of thermally and electrically conductive material, a stump at one side of the disc fastened to the disc, a bimetalic helical spring which has a fixed end fastened to the stump and a movable end with an eyelet for operating the choke valve, and at least one electrical heating element of a resistance material of positive temperature coefficient mounted on an opposite side of the disc, and a plastic housing having a cavity with an inner side wall accommodating the disc, characterized in that the disc has a plurality of cavities in said opposite side of the disc, the plastic housing has a plurality of plastic studs inside the housing cavity inserted into the respective disc cavities locating the disc spaced from the inner side wall of the housing cavity so that the housing contacts the disc solely with the studs, and an elastic ring is fitted into the inner side wall of the housing cavity holding the disc in the housing cavity.

3. A control as set forth in claim 2 further characterized in that the housing studs and the cooperating disc cavities are so disposed in the housing cavith that the subassembly is adapted to be mounted in only one manner in the housing cavity, and said housing has an outer wall with a marking groove therein to serve as a reference point for the spring eyelet when the disc is located in the housing cavity in said one manner by the housing studs.

4. A control as set forth in claim 3 further characterized in that the stump is fixed in an axial cavity of the disc with the spring eyelet in a selected position relative to the disc cavities and housing studs.

5. A control as set forth in claim 2 further characterized in that the elastic ring has lips fitted into corresponding openings in the wall of the housing to aid in anchoring the subassembly in the housing.

6. A control as set forth in claim 5 further characterized in that the elastic ring provides electrical connection of the heater element to electrical ground.

* * * * *